United States Patent [19]

Henriott

[11] Patent Number: 4,566,743

[45] Date of Patent: Jan. 28, 1986

[54] DRAWER SLIDE CLIP

[75] Inventor: Jay M. Henriott, Jasper, Ind.

[73] Assignee: Kimball International, Inc., Jasper, Ind.

[21] Appl. No.: 619,027

[22] Filed: Jun. 11, 1984

[51] Int. Cl.[4] ..... A47B 88/00

[52] U.S. Cl. ..... 312/350; 312/338; 312/345; 308/3.6

[58] Field of Search ..... 312/350, 345, 338, 334; 308/3.6, 3.8

[56] References Cited

U.S. PATENT DOCUMENTS

| | | | |
|---|---|---|---|
| 2,277,703 | 3/1942 | Kennedy et al. | 308/3.6 |
| 3,572,874 | 3/1971 | Hassel | 312/350 |
| 3,677,615 | 7/1972 | Hudson | 312/350 |
| 3,712,698 | 1/1973 | Propst et al. | 312/350 |
| 3,716,284 | 2/1973 | Vogt | 308/3.6 |
| 4,138,176 | 2/1979 | Cowdroy | 312/350 |
| 4,147,393 | 4/1979 | Nelson et al. | 312/350 |
| 4,232,921 | 11/1980 | Peele | 312/350 |
| 4,333,690 | 6/1982 | Keefe et al. | 308/3.6 |

OTHER PUBLICATIONS

Grant Hardware Company Brochure on Shelf Hardware, 1981.

*Primary Examiner*—Victor N. Sakran

*Attorney, Agent, or Firm*—Albert L. Jeffers; John F. Hoffman

[57] ABSTRACT

A drawer slide clip for detachable connection to a track having a plurality of apertures. The clip includes an elongate body having opposite ends. A tab means is at one of the said ends and is intended to engage a selected aperture in the track so as to correctly position the clip relative to the track. A clip means is located at the other end of the elongate body and is intended to engage a selected aperture so as to detachably connect the drawer slide clip to the track. Drawer slide clip further includes an engagement means for engaging a drawer slide.

5 Claims, 6 Drawing Figures

DRAWER SLIDE CLIP

BACKGROUND OF THE INVENTION

The invention relates to a drawer slide clip, and in particular, to a drawer slide clip that can be selectively positioned along the length of a generally vertically disposed track contained within a file cabinet so as to mount a file drawer slide thereto.

A traditional filing cabinet has means for mounting a file drawer slide thereto. The file drawer may then be slidably connected to the file drawer slide. However, these means are rigidly mounted to the interior of the filing cabinet so that they cannot be altered. Consequently, only file drawers of a predetermined size can be accommodated by such a file cabinet.

Heretofore, there have been provided file cabinets that accommodate file drawers of various sizes; and further, that are adjustable so as to vary the size of file drawers that one particular cabinet may accommodate. These systems have performed satisfactorily in the past. However, the ease with which the positioning or repositioning of the drawer slide clips, and hence the drawer slides, can be performed to accommodate file drawers of varying sizes has not been as easy as would be optimally desired. It would thus be desirable to provide a file cabinet having a drawer slide clip that can be relatively easily positioned or repositioned so that the file cabinet can be easily changed to accommodate drawers of different sizes.

SUMMARY OF THE INVENTION

In one form thereof the invention is a drawer slide clip detachably connectable to a track having a plurality of apertures. The clip comprises an elongate body which has opposite ends. A tab means is at one of the ends and is intended to engage a selected aperture in the track so as to correctly position the clip relative to the track. A clip means is at the other end of the elongate body and is intended to engage a selected aperture so as to detachably connect the drawer slide clip to the track.

The clip means includes a flexible leg having an attachment cam surface and a detachment cam surface. Upon attachment of the clip to the track, the attachment cam surface engages the inner peripheral edge of its corresponding aperture so as to flex the leg upon the exertion of a force towards the track so as to permit the leg to engage its corresponding aperture. Upon detachment of the clip from the track, the detachment cam surface engages the inner peripheral edge of its corresponding aperture so as to flex the leg upon the exertion of a force away from the track thereby permitting the leg to be disengaged from its corresponding aperture. The drawer slide clip further includes an engagement means for engaging a drawer slide.

In another form thereof the invention is a pedestal for accommodating one or more file drawers comprising a cabinet having an open front and a pair of side walls. Each of the side walls has an interior surface. A plurality of spaced apart generally vertically disposed tracks are mounted to the interior surface of each side wall. Each track has a plurality of apertures contained therein.

The pedestal further includes a pair of drawer slides as well as a plurality of drawer slide clips. Each of the drawer slide clips includes an elongate body having opposite ends with a tab means at one of the ends and a clip means at the other of the ends. The tab means is intended to engage a selected aperture on the track so as to correctly position the clip relative to the track. The clip means is intended to engage a selected aperture so as to detachably connect the drawer slide clip to the track.

The clip means includes a flexible leg having an attachment cam surface and a detachment cam surface. Upon attachment of the clip to the track, the attachment cam surface engages the inner peripheral edge of its corresponding aperture so as to flex the leg upon the exertion of a force towards the track so as to permit said leg to engage its corresponding aperture. Upon detachment of the clip from the track the detachment cam surface engages the inner peripheral edge of its corresponding aperture so as to flex the leg upon the exertion of a force away from the track thereby permitting the leg to be disengaged from its corresponding aperture. The pedestal further includes an engagement means for engaging a drawer slide as well as a file drawer received by the drawer slides.

It is an object of the invention to provide an improved drawer slide clip detachably connectable to a track having a plurality of apertures wherein the clip is easy to attach or detach so that the drawer slides can be positioned or repositioned to accommodate file drawers of varying sizes.

BRIEF DESCRIPTION OF THE DRAWINGS

The above-mentioned and other features and objects of this invention and the manner of attaining them will become more apparent and the invention itself will be best understood by reference to the following description of a specific embodiment of the invention, taken in conjunction with the accompanying drawings.

DETAILED DESCRIPTION OF A SPECIFIC EMBODIMENT

Figure 1:
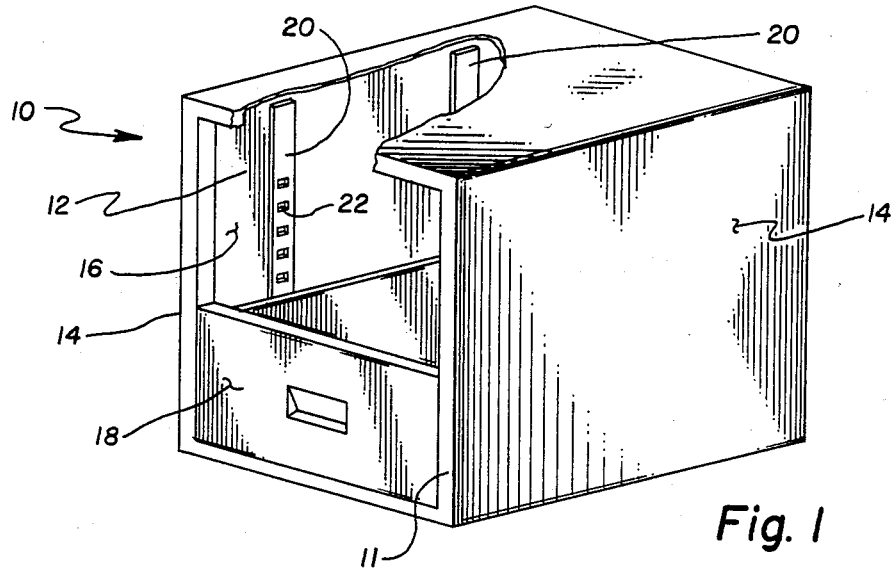
FIG. 1 is a front perspective view of a pedestal having a portion cut-away and one file drawer received therein.

Referring to the drawings, in FIG. 1 there is illustrated a pedestal generally designated as 10. Pedestal 10 includes a front surface 11 in which there is contained an opening 12. Pedestal 10 further includes a pair of opposite side walls 14. Each side wall has an interior surface 16. A file drawer 18 is illustrated in FIG. 1 as being contained in the lower portion of the pedestal 10.

Figure 3:
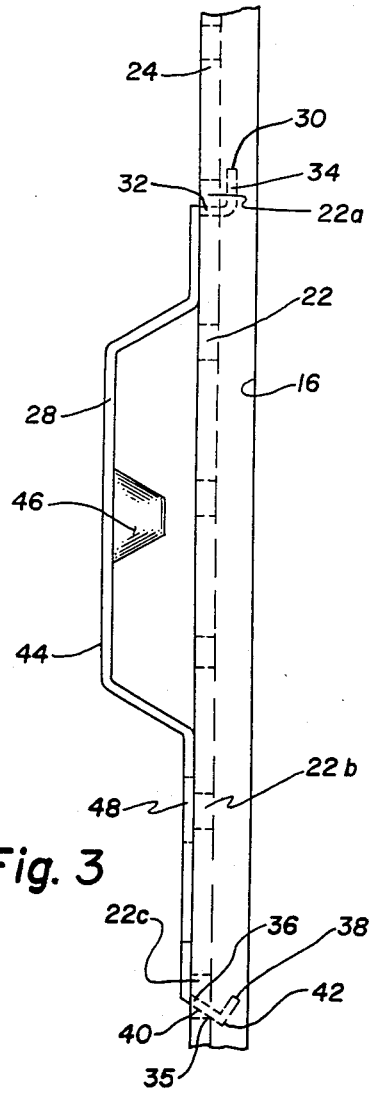
FIG. 3 is a side plan view of the drawer slide clip of FIG. 2.

A pair of elongate vertical tracks 20 are mounted to interior surface 16 of each side wall 14. Each vertical track includes a plurality of generally equi-spaced elongate apertures 22 contained in the front surface 24 of track 20. When vertical track 20 is mounted to interior surface 16, front surface 24 of the track is spaced apart from the interior surface as is illustrated in FIG. 3. Depending upon the number of file drawers received by the pedestal, an appropriate number of drawer slide clips 26 are detachably connected to each vertical track.

Generally speaking, each file drawer requires a drawer slide to be connected to each of its two sides. Each drawer slide requires one drawer slide clip mounted to each vertical track 20.

Figure 2:
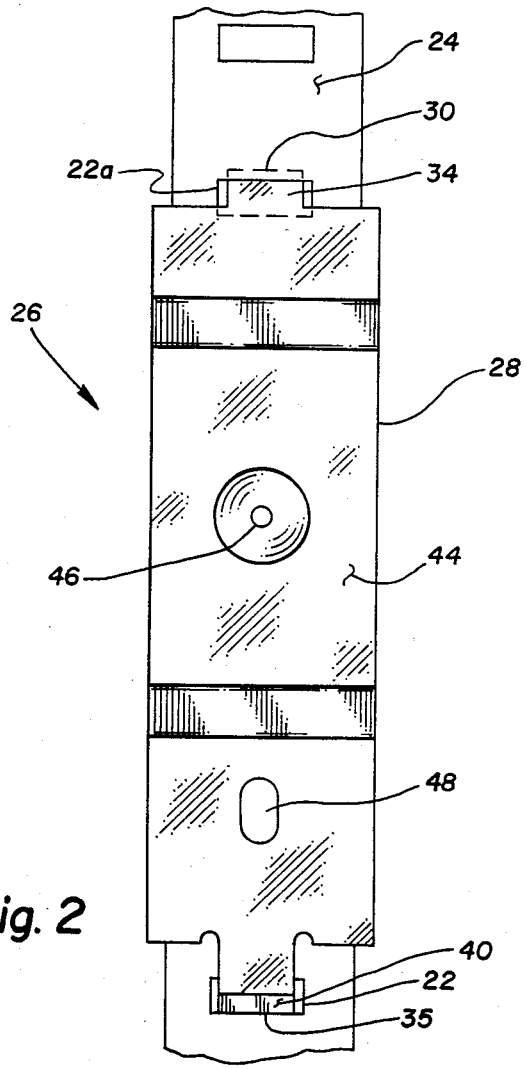
FIG. 2 is a front plan view of a drawer slide clip attached to the vertical track.

Referring in more detail to the construction of the drawer slide clip 26 as illustrated in FIGS. 2 and 3, it is seen that drawer slide clip 26 has an elongate body 28. Elongate body 28 has a tab 30 at one end thereof. Tab 30 comprises a generally horizontally disposed integral leg 32 and a generally vertically disposed integral leg 34. Legs 32 and 34 are of such size so that they are able to fit within the elongate apertures.

Elongate body 28 further includes a clip portion 35 found at the other end thereof. Clip portion 35 includes a pair of integral legs 36 and 38. The proximate leg 36 is disposed at a generally obtuse angle with respect to the longitudinal axis of elongate body 28 and includes a detachment camming surface 40. The distal integral leg 38 is disposed at a generally acute angle with respect to the longitudinal axis of elongate body 28 and includes an attachment camming surface 42. Integral legs 36 and 38 are of such a width so that they can pass through the elongate apertures.

Elongate body 28 further includes a raised mediate portion 44 that is disposed between tab 30 and clip portion 35. Mediate portion 44 contains a conical or tapped hole 46 therein. Hole 46 includes a bottom lip which is adapted to engage the threads of a screw so that a screw or other threaded member may be threaded in or out of hole 46. The portion of elongate body contained between mediate portion 44 and clip portion 35 contains an elongate slot 48 therein. The distance between slot 48 and clip portion 35 is such that the slot 48 matches up with its corresponding elongate aperture **22*b* when the clip portion is itself contained within its own corresponding elongate aperture 22*c***.

When connecting clip 26 to vertical track 20, clip 26 must be disposed a sufficient angle relative to vertical track 20 so as to permit the generally vertically disposed integral leg 34 of tab 30 to be inserted within a selected, or its corresponding, aperture **22*a*. Clip 26 is then moved towards track 20 and pushed slightly upwardly so that vertically disposed integral leg 34 is substantially below top surface 24 and a portion of horizontally disposed integral leg 32 is contained within the volume defined by its corresponding aperture 22*a*. It is now seen that tab 30 facilitates the correct positioning of the clip relative to the truck since it is at this point that the clip portion 35 is adjacent to its corresponding aperture 22*c* as illustrated in FIG. 5A**.

Figure 5B:
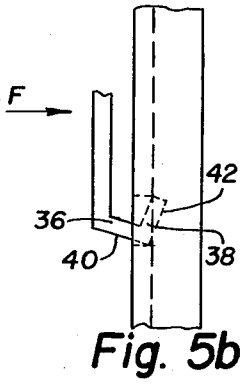
FIGS. 5A and 5B are side plan views showing the clip portion being inserted onto its corresponding aperture.
Figure 5A:
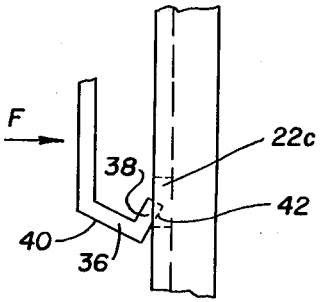
Figure 4:
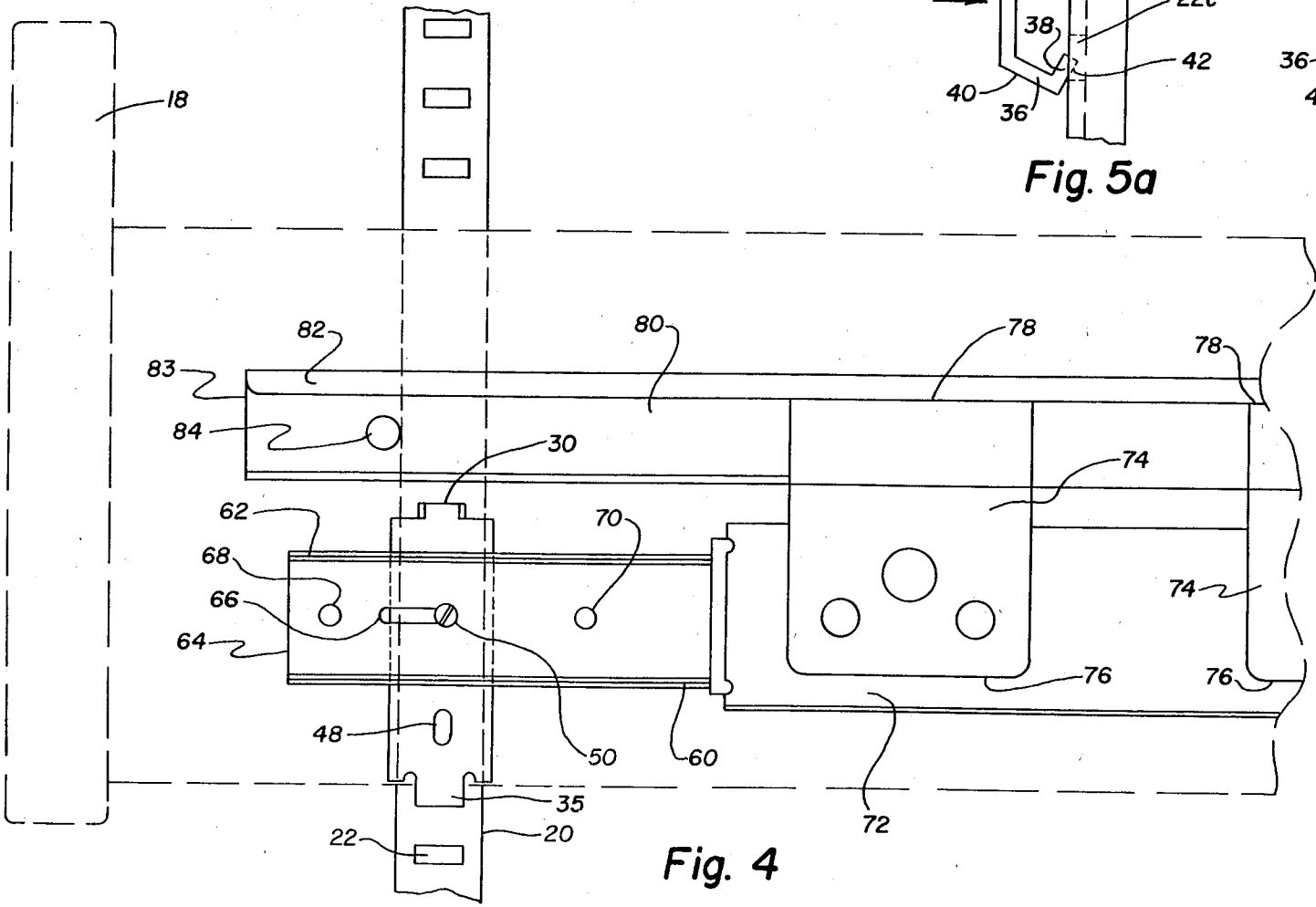
FIG. 4 is a plan view illustrating the engagement of a drawer slide to the drawer slide clip with the file drawer shown by broken lines.

Referring more specifically to FIGS. 5A and 5B, at this point in the attachment of drawer slide clip 26 to vertical track 20, camming surface 42 of the distal integral leg 38 rests against that portion of the track that defines the lower periphery of aperture **22*c*. Clip portion 35 is somewhat flexible so that upon the application of a force F in the general direction of vertical track 20, camming surface 42 causes clip portion 35 to move slightly upwardly as illustrated in FIG. 5B. Upon continued application of force F, distal integral leg 38 is able to pass through aperture 22*c* and a portion of proximate integral leg 36 is thereby contained within the volume defined by aperture 22*c***.

Although it is not illustrated, a connection assembly such as a nut and bolt may pass through slot 48 and its corresponding aperture **22*b* so as to more securely mount drawer slide clip 26 to vertical track 20**.

A drawer slide assembly 60 is located to each side of the file cabinet. Although the drawer slide is of a conventional construction, Applicant will herein briefly describe the basic elements thereof. Drawer slide assembly 60 includes an elongate rail having opposite ends. Only one end 64 of rail 62 is illustrated. A slot 66 is contained in rail 62 near each end thereof. Slot 66 is in general longitudinal alignment with a pair of apertures 68 and 70. One aperture 68 being on one side of slot 66, and the other aperture 70 being on the other side of slot 66.

In order to secure rail 62 to the interior surface of its corresponding side wall, rail 62 is positioned in a generally horizontal position so that each slot 66 lines up with a conical hole contained in its corresponding clip 26. It should be appreciated that the distance between the spaced-apart vertical tracks must fall within a certain tolerance so that this alignment is possible. A screw 50 is enthreaded into conical hole 46. The head of screw 50 is of a sufficiently large diameter (greater than the width of slot 66) so that a portion of elongate rail 62 near slot 66 is contained between the head of screw 50 and mediate portion 44 of the drawer slide clip. It should be understood that this connection is made at each end of rail 62 so that rail 62 is securely mounted to each clip 26 which, in turn, is attached to each track mounted to its corresponding side wall. An elongate slide member 72 slidably receives rail 62 therein. Slide member 72 includes a channel (not illustrated) in which rail 62 can slide relative to slide member 72. It should be appreciated that rollers or other type of bearing means can be used to provide the sliding relationship between slide member 72 and rail 62. Slide member 72 is shorter in length than rail 62 so that it does not extend as far to the front or to the rear as does rail 62. Slide member 72 includes a plurality of upper projections 74, each being connected at the bottom end thereof to slide member 72. The top ends of projections 74 are received within a channel 82 of an elongate drawer rail 80. Elongate drawer rail 80 has opposite ends, only one of which 83 is illustrated, and contains a generally circular aperture 84 near each end thereof. It is by these apertures 84 in conjunction with associated structure in the file drawer that elongate drawer rail 80 can be rigidly mounted to file drawer by screws (not illustrated) or other connectors. It should now be appreciated that by the above-described structure relating to the drawer slide assembly 60 that the file drawer is able to easily slide in and out of the interior of the file cabinet.

The slidable connection between slide member 72 and drawer rail 80 is such that drawer 18 can be pulled from the file cabinet to a selected position at which the file drawer and its attached elongate drawer slide can be disengaged from remainder of the drawer slide assembly 60. It is in this condition that the drawer slide clips 26 can be repositioned so as to suit file drawers of varying sizes. In order to do this, screw 50 is unthreaded from conical hole 46 so that the remainder of the sliding assembly 60 can be removed from inside of the file cabinet.

Once the complete drawer slide assembly 60 as well as the file drawer have been removed from inside the file cabinet, the drawer slide clip 26 should be pulled away from vertical track 20. This can be most conveniently done by grasping mediate portion 44.

This pulling away translates into a force directed in the opposite direction to force F illustrated in FIGS. 5A and 5B. As a result of this outward force, camming surface 40 of proximate integral leg 36 engages that portion of the track that defines the lower periphery of aperture 22c. As the outward force continues to be exerted, the interaction between the lower periphery of aperture 22c and camming surface 40 causes clip portion 35 to bend in an upward direction thereby permitting the clip portion 35 to be easily removed from its corresponding aperture 22c. Drawer slide clip 26 is then moved away from vertical track 20, and tab 30 is then withdrawn from its corresponding aperture 22a. At this point, the drawer slide clips 26 can be repositioned as previously described. Once clips 26 are appropriately repositioned, elongate rail 62 can be mounted to clips 26, the slide member 72 connected to elongate rail 62, and the file drawer then slidably connected to the slide member 72 via elongate drawer rail 80.

It is thus seen that applicant is provided an improved drawer slide clip detachably connectable to a track having a plurality of apertures wherein the track is utilized with a pedestal containing one or more file drawers. Applicant's improved drawer slide clip can be easily attached or detached from its respective vertical tracks so as to allow the pedestal to relatively easily accommodate file drawers of varying sizes.

While the invention has been described as having a specific embodiment, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A drawer slide clip detachably connectable to a track having a plurality of apertures, the clip comprising:

a body having opposite ends;

tab means, at one of said ends, for engaging a selected aperture in the track so as to correctly position the clip relative to the track;

clip means, at the other of said ends, for engaging a selected aperture so as to detachably connect the drawer slide clip to the track, said clip means including a flexible leg having an attachment cam surface means for engaging an inner peripheral edge of its corresponding aperture and flexing said leg upon the exertion of force towards the track to permit said leg to enter the corresponding aperture, said leg further having detachment cam surface means for engaging an inner peripheral edge of the corresponding aperture and flexing said leg upon the exertion of force away from the track thereby permitting said leg to disengage from the corresponding aperture; and engagement means for engaging a drawer slide.

2. The drawer slide clip of claim 1 wherein said engagement means includes a raised mediate portion on said body, said mediate portion having a conical aperture therein.

3. A pedestal in which are mounted one or more file drawers comprising:

a cabinet having an open front and a pair of side walls, each of said side walls having an interior surface;

a plurality of vertically disposed tracks spaced apart and mounted to said interior surface of each side wall, each track having a plurality of apertures contained therein;

a plurality of drawer slide clips mounted to said respective tracks, each of said drawer slide clips including:

a body having opposite ends, tab means, at one of said ends, for engaging a selected aperture in the track so as to correctly position the clip relative to the track, clip means, at the other of said ends, for engaging a selected aperture so as to detachably connect the drawer slide clip to the track, said clip means including a flexible leg having an attachment cam surface means for engaging an inner peripheral edge of its corresponding aperture and flexing said leg upon the exertion of force toward the track to permit said leg to enter the corresponding aperture, said leg further having detachment cam surface means for engaging an inner peripheral edge of the corresponding aperture and flexing said leg upon the exertion of force away from the track thereby permitting said leg to disengage from the corresponding aperture;

a pair of drawer slides connected to said clips; and a file drawer supported on said drawer slides.

4. A drawer slide clip adapted for detachably connecting to a track having a plurality of apertures, the clip comprising:

an elongate body having opposite ends;

tab means, at one of said ends, for engaging a selected aperture in the track so as to correctly position the clip relative to the track;

clip means, at the other of said ends, for engaging a selected aperture so as to detachably connect the drawer slide clip to the track, said clip means including a flexible leg having a detachment cam surface means attached to said leg at an obtuse angle with respect to said elongate body and an attachment cam surface means attached to said detachment cam means surface at an acute angle with respect to said elongate body, said attachment cam surface means slidably engaging the inner peripheral edge of its corresponding aperture during attachment and said detachment cam surface means slidably engaging said inner peripheral edge of said aperture during detachment of said slide clip from said track; and engagement means for engaging a drawer slide.

5. The drawer slide clip of claim 4 wherein said engagement means includes a raised mediate portion on said body, said mediate portion containing a conical aperture therein.

* * * * *